US009687402B2

(12) United States Patent
Ellis et al.

(10) Patent No.: US 9,687,402 B2
(45) Date of Patent: Jun. 27, 2017

(54) BED RAIL ORGANIZER

(71) Applicants: Jerry Ellis, Chapmansboro, TN (US); John Hibler, Nashville, TN (US)

(72) Inventors: Jerry Ellis, Chapmansboro, TN (US); John Hibler, Nashville, TN (US)

( * ) Notice: Subject to any disclaimer, the term of this patent is extended or adjusted under 35 U.S.C. 154(b) by 0 days.

(21) Appl. No.: 15/094,444

(22) Filed: Apr. 8, 2016

(65) Prior Publication Data

US 2016/0324708 A1 Nov. 10, 2016

Related U.S. Application Data

(60) Provisional application No. 62/158,586, filed on May 8, 2015.

(51) Int. Cl.
*A61G 7/05* (2006.01)

(52) U.S. Cl.
CPC ..... *A61G 7/0507* (2013.01); *A61G 7/0503* (2013.01)

(58) Field of Classification Search
CPC ..... A47C 21/00; A47C 21/083; A47C 7/68; A47C 7/70; A61G 7/0503; A61M 2025/024; A61M 2025/028
See application file for complete search history.

(56) References Cited

U.S. PATENT DOCUMENTS 3,078,478 A * 2/1963 Sheahan ..... A47D 7/007 108/49
3,233,563 A * 2/1966 Mauchline ..... B60N 3/002 108/135
3,239,272 A * 3/1966 Wilkins ..... A47C 7/68 211/119.007
3,473,772 A * 10/1969 Nilson ..... A61G 7/0503 248/214
3,586,368 A * 6/1971 Guild ..... A47C 7/68 297/135
4,270,724 A * 6/1981 McMullen ..... F16M 13/02 248/230.4
4,416,664 A * 11/1983 Womack ..... A61M 25/02 604/174
4,560,128 A * 12/1985 Willeby ..... A47C 7/62 24/517
4,795,441 A * 1/1989 Bhatt ..... A61G 7/0503 128/DIG. 26
4,858,796 A * 8/1989 Roth ..... B60N 3/002 108/46

(Continued)

*Primary Examiner* — Patrick Hawn
(74) *Attorney, Agent, or Firm* — Global Intellectual Property Agency, LLC; Daniel Boudwin

(57) ABSTRACT

A bed rail organizer device is provided that is supported by the upper surface of a bed rail and acts as a cradle for supporting articles and equipment. The device comprises a first end that comprises one or more cradle pockets adapted for supporting items therein, including personal items or medical equipment. A bed rail strip is disposed opposite of the pockets and along the second end of the device. The bed rail strip comprises an elongated surface having one or more bed rail attachments along the lower surface thereof. Along the upper surface of the bed rail strip are one or more hose clamps, which are adapted to support medical hoses and lines crossing the threshold of the bed. In this manner, the organizer device is suited for supporting medical and personal items from the side rail of the bed.

5 Claims, 3 Drawing Sheets

(56) References Cited

U.S. PATENT DOCUMENTS 4,863,134 A * 9/1989 Young ..... A47C 7/68 248/118
4,955,864 A * 9/1990 Hajduch ..... A61B 17/132 128/DIG. 15
5,257,765 A * 11/1993 Halle ..... A47C 7/68 248/222.13
5,334,186 A 8/1994 Alexander
5,458,394 A * 10/1995 Nichols ..... A47B 23/02 297/153
5,490,710 A * 2/1996 Dearing ..... A47C 7/70 248/118.5
5,727,759 A * 3/1998 Christensen ..... A47C 7/68 248/118
5,967,345 A * 10/1999 Subotin ..... A47C 7/62 211/119.007
6,253,399 B1 * 7/2001 Wagner ..... A47B 23/025 108/49
6,290,063 B1 * 9/2001 Vogt ..... B60N 3/106 206/549
6,298,793 B1 * 10/2001 Turner ..... A47D 1/008 108/26
6,352,303 B1 * 3/2002 Hope ..... A47C 7/68 248/918
6,467,839 B1 * 10/2002 Kain ..... B60N 2/28 248/311.2
6,484,989 B1 * 11/2002 Connery ..... A47D 1/008 108/26
7,043,778 B1 * 5/2006 Georgitsis ..... A47D 9/00 108/49
7,134,714 B1 * 11/2006 Connery ..... A47D 1/008 248/311.2
7,243,991 B2 * 7/2007 Ojeda ..... B60N 2/4686 108/25
7,360,829 B2 * 4/2008 Bufkin ..... A47C 7/70 297/162
7,398,951 B1 * 7/2008 Sugalski ..... A61G 7/0503 248/214
7,527,158 B2 * 5/2009 Gainer ..... A47B 17/036 211/113
8,267,260 B2 * 9/2012 Zhang ..... A47D 15/00 190/109
8,333,429 B2 * 12/2012 Nelson ..... A47C 7/62 297/188.14
8,387,807 B2 * 3/2013 Chen ..... A47D 7/007 211/119.006
8,578,528 B1 11/2013 Heare
8,900,196 B2 * 12/2014 Andino ..... A61M 5/1418 604/174
2002/0018601 A1 2/2002 Nelson
2011/0062162 A1 3/2011 Thomas
2011/0121619 A1 * 5/2011 Chappell ..... A47C 7/62 297/188.01
2013/0200229 A1 * 8/2013 Corey ..... A47D 15/00 248/205.1
2013/0305451 A1 11/2013 Asaf

* cited by examiner

BED RAIL ORGANIZER

CROSS REFERENCE TO RELATED APPLICATION

This application claims the benefit of U.S. Provisional Application No. 62/158,586 filed on May 8, 2015. The above identified patent application is herein incorporated by reference in its entirety to provide continuity of disclosure.

BACKGROUND OF THE INVENTION

Field of the Invention

The present invention relates to organizational devices and hospital bed cradles for item storage. More specifically, the present invention relates to an item cradle that is affixable to the upper surface of a hospital bed rail and provides an organizational device for items and for medical lines or hoses.

Individuals admitted to the hospital often have limited mobility and are physically limited to bed rest. In such instances, it can be difficult for patients to reach for personal effects, television remotes, nurse pagers, and other items. These items can become entangled in bed linens if left on the bed, and can become out of reach if misplaced or dropped. Therefore, an organizer device that affixes to a hospital bed is desired. While bed side tables are useful, these items may interfere with necessary medical equipment at the bedside, and moreover may support the items out of reach of the user in the bed.

The present invention provides a cradle for personal items, as well as a general organizer than can support personal items and medical lines. The present invention comprises a cradle that is affixable to the upper surface of a hospital bed rail, and provides one or more cradle pockets for supporting items therein. Along the cradle device are also provided clips for securing medical lines and hoses thereto. This maintains the hoses and lines against the bed rail in a separated and organized manner. Since medical tubes and lines can often become tangled with linens and the user when crossing the bedside threshold, the present invention provides a combination device with dual benefits—personal item storage and hospital line organization.

SUMMARY OF THE INVENTION

The following summary is intended solely for the benefit of the reader and is not intended to be limiting in any way. The present invention provides a new bed rail organizer device that can be utilized for providing convenience for the user by supporting medical and/or personal items from the side rail of a bed.

It is therefore an object of the present invention to provide a new and improved bed rail organizer device that has all of the advantages of the prior art and none of the disadvantages.

It is another object of the present invention to provide a bed rail organizer device that affixes to the bed side rail and is adapted to support personal items and/or medical equipment.

Another object of the present invention is to provide a bed rail organizer device that comprises an item cradle having a first end, a second end, sides, and a lower surface. The first end of the item cradle includes one or more pockets while the second end comprises a bed rail strip that affixes to the upper surface of a bed rail.

Another object of the present invention is to provide a bed rail organizer device wherein the one or more pockets comprise sidewalls, an open upper, and an interior volume.

Another object of the present invention is to provide a bed rail organizer device wherein the one or more pockets have an upper edge, and whereby the bed rail strip extends from the upper edge of one of the one or more pockets.

Another object of the present invention is to provide a bed rail organizer device wherein the one or more pockets comprising a pair of pockets aligned adjacently to one another. Each of the pockets has an upper edge, whereby the upper edges of the pockets are disposed in substantially a shared plane.

Another object of the present invention is to provide a bed rail organizer device whereby the one or more pockets and the bed rail strip are formed or molded from a unitary assembly.

Another object of the present invention is to provide a bed rail organizer device whereby each of the adjacent pockets has at least one sidewall adjacent to the sidewall of an adjacent pocket. In one embodiment, each of the adjacent sidewalls are connected along an upper extent and formed together.

Another object of the present invention is to provide a bed rail organizer device whereby the bed rail strip has a lower surface having one or more bed rail attachments thereon that are adapted to secure to and substantially clamp around the upper surface of the bed rail.

Another object of the present invention is to provide a bed rail organizer device whereby the bed rail strip further has an upper surface that comprises one or more hose clips each adapted to removably secure a hose or line to the upper surface of the bed rail strip.

Another object of the present invention is to provide a bed rail organizer device whereby each of the one or more pockets has a pair of aligned slots disposed through opposing sidewalls along the sides of the item cradle.

Another object of the present invention is to provide a bed rail organizer device wherein each of the one or more pockets is connected along the lower surface.

Another object of the present invention is to provide a bed rail organizer device whereby the bed rail attachments along the lower surface of the bed rail strip further comprise a pair of complimentary clip arms adapted to receive the upper surface of the bed rail therebetween.

Another object of the present invention is to provide a bed rail organizer device whereby the hose clips along the upper surface of the bed rail strip further comprise a pair of complimentary hose clip arms adapted to receive the hose or line therebetween.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
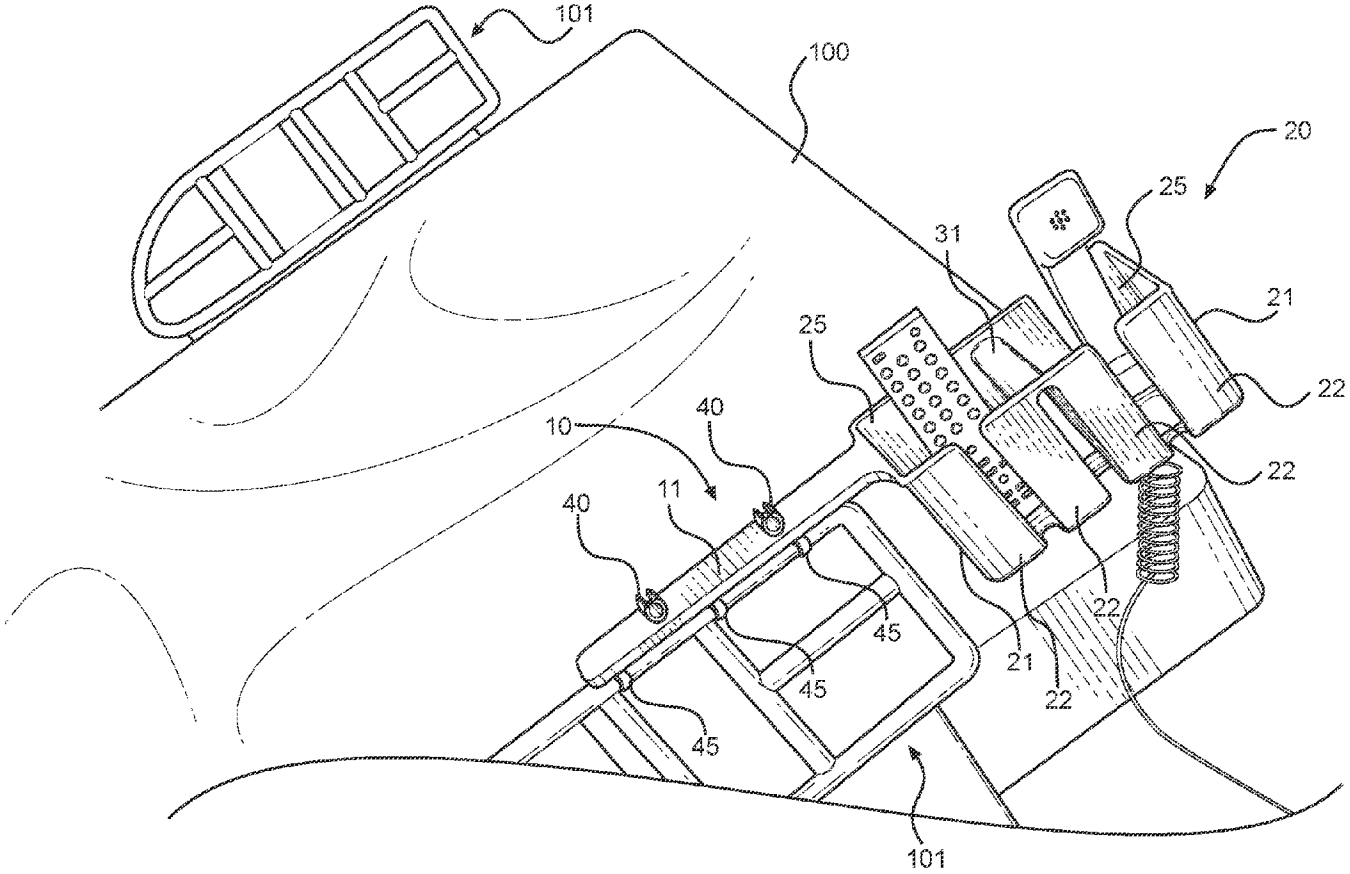
FIG. 1 shows a side view of the bed rail organizer device of the present invention in a working state, secured to the side rail of a bed.

Reference is made herein to the attached drawings. Like reference numerals are used throughout the drawings to depict like or similar elements of the bed rail organizer device of the present invention. For the purposes of presenting a brief and clear description of the present invention, the preferred embodiment will be discussed as used for supporting personal items and medical equipment within a cradle affixable to the side rail of a bed. The figures are intended for representative purposes only and should not be considered to be limiting in any respect.

Figure 2:
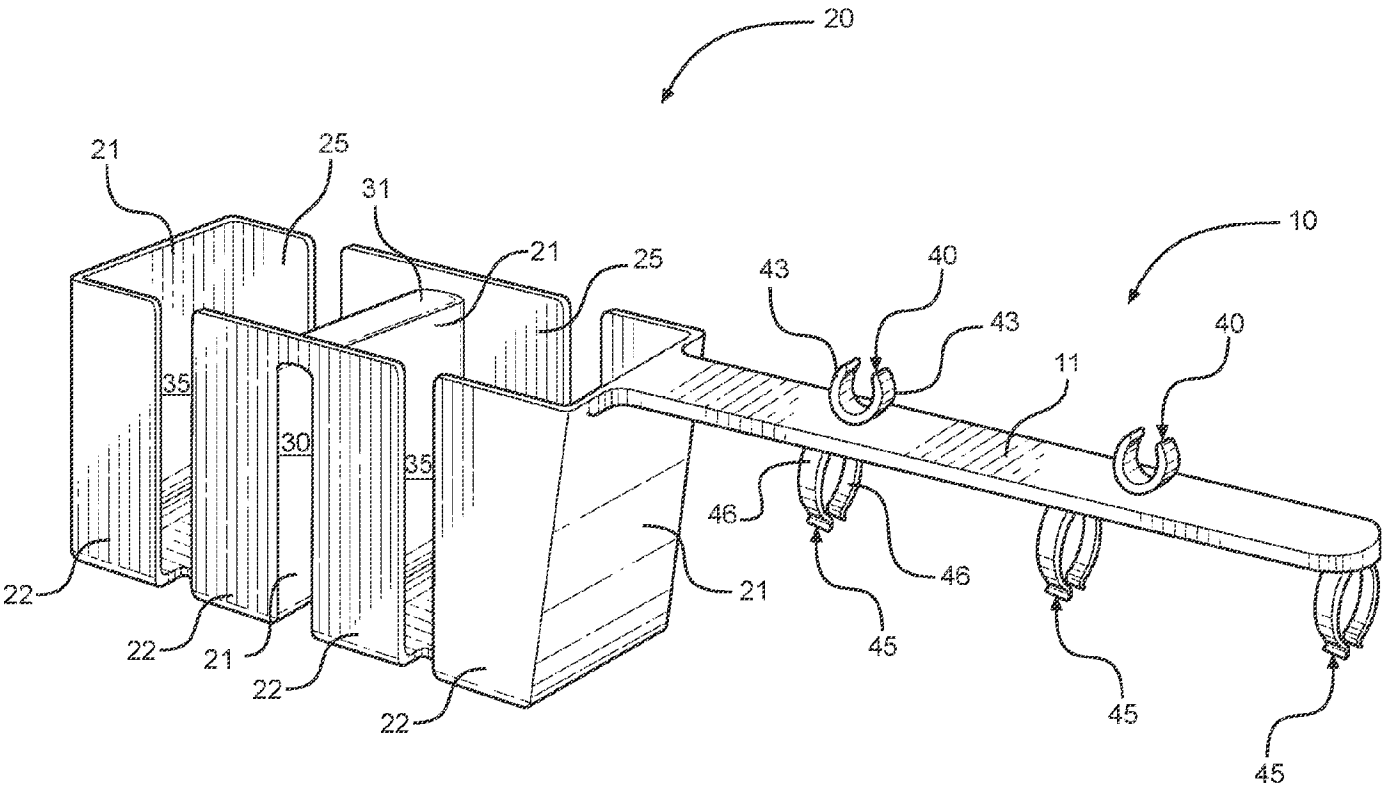
FIG. 2 shows a perspective view of the bed rail organizer device of the present invention.
Figure 3:
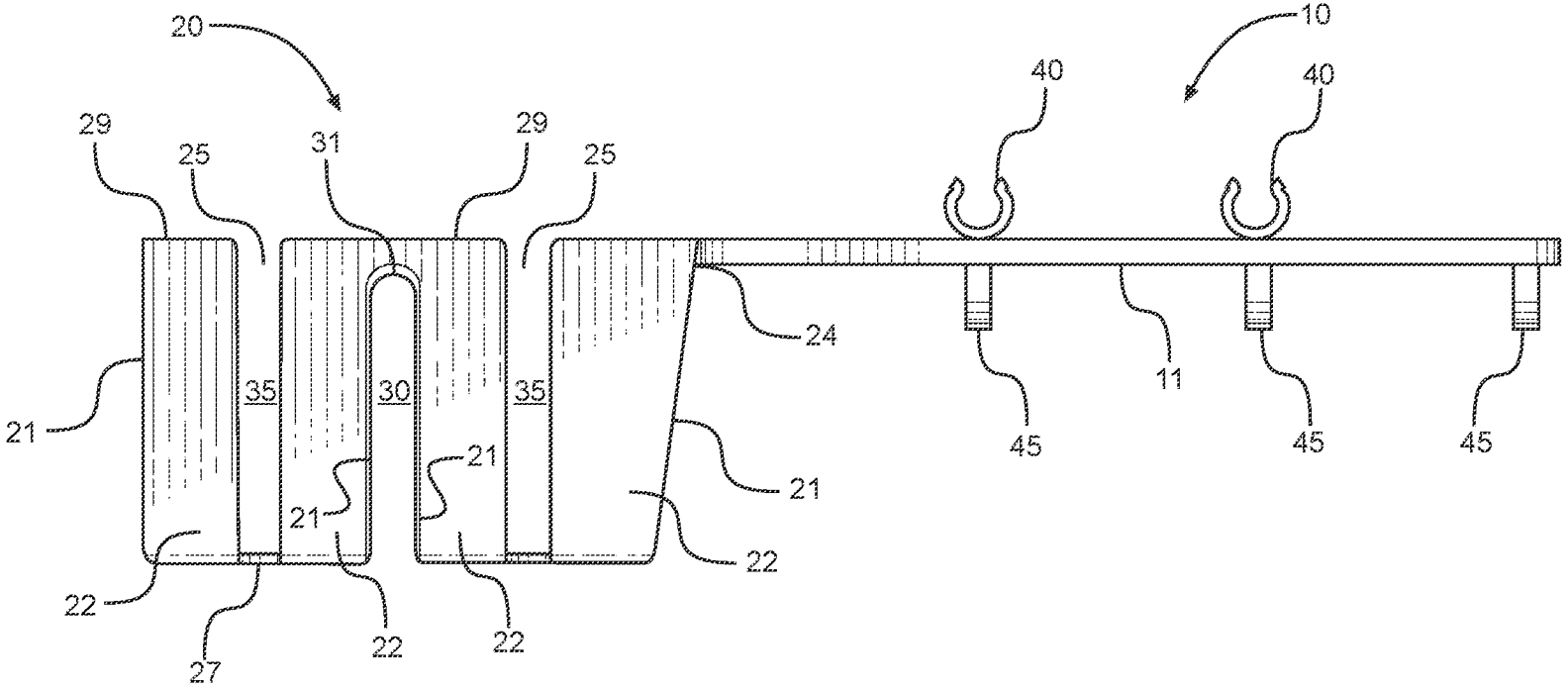
FIG. 3 shows a side view of the bed rail organizer device of the present invention.

Referring now to FIGS. 1-3, there are shown several views of the bed rail organizer device of the present invention. The organizer device is one that is adapted to be secured to the upper surface of a bed rail 101 and offer storage and organization. Personal items and medical equipment can be stored in the device, while medical lines and hoses can also be secured thereto as they cross the threshold of the bed. The device therefore organizes personal items and medical equipment, and prevents entanglements with medical lines and hoses.

In particular, the present invention comprises an item cradle having a first end 20 and a second end 10. The first end 20 comprises one or more pockets 25 for supporting items. The second end 10 comprising a bed rail strip 11 extends from the pockets 25 and is adapted to secure the device to the upper surface of a bed rail 101. In one embodiment, the organizer device is comprised of a plastic material and is a formed or molded part. That is, the pockets 25 and bed rail strap 11 are formed of a single molded part. Other embodiments are contemplated, including fastened or connected assemblies that are not a single, molded part.

The bed rail strip 11 of the device is one that is adapted to be positioned over the upper surface of a bed rail 101 and connected thereto. Once the bed rail strip 11 is secured, the pockets 25 extend from the end of the bed rail 101 are substantially aligned with the bed rail 101. Securing the bed rail strip 11 to the bed rail 101 are one or more bed rail attachments 45 along the lower surface of the strip 11. The bed rail attachments 45 are adapted to secure to and substantially clamp around the upper surface of the bed rail 101, supporting the bed rail strip 11 against the bed rail 101 while cantilevering the pockets 25 and the first end 20 of the device from an end of the bed rail 101. In one embodiment, the bed rail attachments each comprise a pair of complimentary clip arms 46 adapted to receive the upper surface of the bed rail 101 therebetween. The clip arms 46 form rounded arm sections with a gap therebetween and an open interior within which to receive the bed rail 101 therein.

Opposite of the bed rail strip 11 and along the first end 20 of the device are one or more pockets 25. The pockets 25 are preferably formed depressions with upstanding sidewalls 22 and end walls 21. Alternatively, the pockets 25 may comprise one or more pockets that are fastened together and adjacent to one another along the first end 20 of the device. In either embodiment, the one or more pockets 25 comprise opposing sidewalls 22 and opposing end walls 21 to form substantially rectangular depressions. Each of the pockets 25 includes an open interior, which may have a tapered cross section or constant cross section.

In one embodiment, the pockets 25 comprise at least two pockets that are disposed adjacent to one another. The adjacent pockets 25 include adjacent end walls 21 and two adjacent sidewalls 22 that are formed together to connect the two pockets together. As shown in FIG. 2, the adjacent end walls 21 form together along an upper extent 31, while the sidewalls 21 of the adjacent pockets are also formed together. In this embodiment, the adjacent pockets 25 are separated by a void 30 therebetween. Similarly, each of the pockets 25 includes a pair of slots 35 extending through the opposing sidewalls 22. The pockets 25 may be connected only by way of the adjacent sidewalls 22 and end walls 21, or they may also be connected along the lower surface 27 of each pocket 25. The lower surface 27 (FIG. 3) may extend across the void 30 between the pockets, or alternatively the lower surface of the pockets 25 may be separated from one another (as shown). It is not desired to limit the construction of the organizer device of the present invention, but rather to disclose several example embodiments falling within the scope of the claims. The examples listed are not exhaustive.

The one or more pockets 25 comprise an open upper 29 and an interior volume adapted to receive and contain items therein. The sidewalls 22 of the device may form a rectangular pocket shape with perpendicular end walls 21 and side walls 22, or alternatively the side walls 22 may form a rounded or otherwise faceted cross section. The bed rail strip 11 preferably secures to a first pocket 25 along an end wall 21 or sidewall 22 thereof, whereby the bed rail strip 11 extends from an upper edge 24 thereof. In this manner, the bed rail strip 11 is substantially planar and in-plane with the open upper surfaces 29 of the one or more pockets 25. The pockets 25 extend downward from this shared plane, forming a structure in which the pockets are disposed below the bed rail strip 11.

Along the upper surface of the bed rail strip 11 are one or more hose clips 40 thereon. The hose clips 40 are clip structures that are preferably aligned with one another and are adapted to support hoses or medical lines that cross over the bed rail strip 11. Thus, the clips 40 support the lines or hoses as they cross perpendicularly over the bed rail strip with respect to its length, thereby separating the lines and retaining their position against the bed rail strip 11 as the lines cross the threshold of the bed. Preferably, the clips 40 each comprise a pair of complimentary hose clip arms 43 that are adapted to receive the medical hose or line therebetween.

Overall, the present invention provides a bed side rail organizer. The device preferably comprises a molded or formed plastic device for supporting personal and/or medical articles therein and thereon. For example, the device may comprise an injected molded, plastic part having a pair of aligned and adjacent pockets. Alternatively, the device may be fastened together, whereby discrete pockets and bed rail strip elements are connected together to form the device. The pockets are adapted to store everyday items or medical equipment therein, while the medical hose clips are adapted to secure medical lines and tubes to the device for better organization. Overall, the device provides a storage unit capable of being attached to the bed rail and securing medical and/or personal items to the bed rail of a bed. In one contemplated setting, the bed rail is a hospital bed rail.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An organizer device for securing to a bed rail, comprising:

an item cradle including a first end having a plurality of pockets and a second end including a bed rail strip;

the plurality of pockets including an open upper, a pair of opposing sidewalls, a pair of end walls, and a lower surface defining an interior volume, each of the plurality of pockets aligned and interconnected at an opposing end wall via an upper extent, and interconnected at the pair of opposing sidewalls and at the lower surface;

the upper extent positioned below an upper edge of the opposing end walls; and the bed rail strip including a planar member affixed to an upper edge of an opposing end wall of one of the plurality of pockets, the planar member extending outwardly relative to the opposing end wall on which the planar member is affixed, and wherein the pair of opposing sidewalls each include a slot extending longitudinally from an upper edge of the sidewall to the lower surface of the pocket, the slots being aligned with one another.

2. The organizer device of claim 1, further comprising a first fastener disposed on a lower surface of the bed rail strip and a second fastener disposed on an upper surface of the bed rail strip.

3. The organizer device of claim 2, wherein the first fastener comprises a clamp having complimentary arms forming a gap therebetween sized to receive a tubular member and the second fastener comprises a clip having complimentary arms forming a gap therebetween sized to receive a tubular member.

4. The organizer device of claim 1, wherein a cross section of the interior volume of the pocket is constant in diameter from the upper end to the lower surface.

5. The organizer device of claim 1, wherein a cross section of the interior volume of the pocket tapers in diameter from the upper end to the lower surface.

* * * * *